US006572494B2

(12) United States Patent
Emerson et al.

(10) Patent No.: US 6,572,494 B2
(45) Date of Patent: Jun. 3, 2003

(54) DISTANCE GOLF BALL-DDH STEEL DISTANCE

(75) Inventors: Brent D. Emerson, Centtral, SC (US); George R. Wallace, Clemson, SC (US); Matthew B. Stanczak, Jackson, TN (US); Sanjay Kuttappa, Clemson, SC (US)

(73) Assignee: Dunlop Slazenger Manufacturing, Westminster, SC (US)

( * ) Notice: Subject to any disclaimer, the term of this patent is extended or adjusted under 35 U.S.C. 154(b) by 0 days.

(21) Appl. No.: 09/884,612

(22) Filed: Jun. 19, 2001

(65) Prior Publication Data

US 2002/0016227 A1 Feb. 7, 2002

Related U.S. Application Data

(60) Provisional application No. 60/212,386, filed on Jun. 19, 2000.

(51) Int. Cl.[7] ..... A63B 37/12; A63B 37/14; A63B 37/00

(52) U.S. Cl. ..... 473/378; 473/381; 473/351

(58) Field of Search ..... 473/351–385

(56) References Cited

U.S. PATENT DOCUMENTS 4,877,252 A * 10/1989 Shaw ..... 473/379
4,884,814 A * 12/1989 Sullivan ..... 473/372
5,127,655 A * 7/1992 Yamada et al. ..... 473/384
5,470,076 A * 11/1995 Cadorniga ..... 473/379
5,683,312 A * 11/1997 Boehm et al. ..... 473/354
5,779,562 A * 7/1998 Melvin et al. ..... 473/373
6,037,419 A * 3/2000 Takesue et al. ..... 525/329.9
6,059,671 A * 5/2000 Asakura ..... 473/383
6,241,627 B1 * 6/2001 Kasashima et al. ..... 473/378
6,383,093 B1 * 5/2002 Kuttappa et al. ..... 473/378
6,390,938 B1 * 5/2002 Asakura et al. ..... 473/378

* cited by examiner

*Primary Examiner*—Paul T. Sewell
*Assistant Examiner*—Alvin A. Hunter, Jr.
(74) *Attorney, Agent, or Firm*—Lorusso Loud & Kelly LLP; Jeffrey D. Washville; Marc A. Vivenzio

(57) ABSTRACT

The golf ball comprises all known cores provided with a cover produced by a polymer blend that combines the durability of a conventional cover with the feel of a traditional balata cover having a plurality of dimples in a modified dodecahedron pattern. The dodecahedron consists of twelve pentagons, which are subdivided into a total of sixty triangles. The triangles are then further subdivided into rows into which various diameter dimples are placed. The dimple pattern can be arranged to produce a pattern of ten great circles, which are free of dimples. The cover formulation is a blend of various ethylene/methacrylic acid copolymers wherein at least one copolymer has a high modulus and at least one copolymer has a moderate modulus forming a miscible blend having a PDI index that maximizes durability while still maintaining feel and playability.

23 Claims, 8 Drawing Sheets

DISTANCE GOLF BALL-DDH STEEL DISTANCE

CROSS-REFERENCE TO RELATED APPLICATIONS

A claim of benefit is made to provisional application ser. No. 60/212,386 filed on Jun. 19, 2000, which is herein incorporated by reference.

FIELD OF THE INVENTION

The invention is directed to golf balls, and more particularly to a ball having the optimal core compression, core diameter, cover hardness, and dimple configuration to provide superior playability capabilities with respect to softness and spin without sacrificing distance capabilities.

DESCRIPTION OF THE PRIOR ART

There are a number of physical properties that affect the performance of a golf ball. The core of the golf ball is the source of the ball's energy. Among other things, the core affects the ball's "feel" and its initial velocity. The "feel" is the overall sensation transmitted to the golfer through the golf ball after striking a ball. The initial velocity is the velocity at which the golf ball travels when first struck by the golf club. The initial velocity, together with the ball's trajectory, determine how far a shot will travel.

Until the late 1960's most golf balls were constructed as three-piece wound balls. In the three-piece wound ball, a solid or liquid-filled center is wound with rubber windings to form a core, which is then covered with a cover of compounds based on natural (balata or guta percha) or synthetic transpolyisoprene. During the manufacturing process, after the liquid-filled center is formed, it is frozen to make it as hard as possible so that it will retain its spherical shape while the rubber thread is wrapped around it.

These three-piece wound balls were known and are still known to provide acceptable flight distance and soft feel. Additionally, due to the relative softness of the balata cover, skilled golfers are able to impart various spins on the ball in order to control the ball's flight path (e.g. "fade" or "draw") and check characteristics upon landing on a green.

With the advent of new materials developed through advances and experimentation in polymer chemistry, two-piece golf balls were developed. The primary difference between a two-piece golf ball and a three-piece golf ball is the elimination of the rubber thread windings found in the three-piece balls. A relatively large solid core in a two-piece ball takes the place of the relatively small center and thread windings of a three-piece ball core having the same overall diameter. With the elimination of the thread windings, there is no need to freeze the core during the manufacturing process of the two-piece golf ball.

Two-piece balls have proven to be more durable than three-piece balls when repeatedly struck with golf clubs and more durable when exposed to a variety of environmental conditions. An example of these environmental conditions is the high temperature commonly experienced in an automobile trunk. In addition, two piece balls are typically less expensive to manufacture than the three-piece wound balls. However, two-piece balls are, in general, considered to have inferior characteristics of feel and workability when compared to three-piece balls. Generally and historically, two piece balls use harder cover materials for increased durability. The "hardness" of a golf ball can affect the "feel" of a ball and the sound or "click" produced at contact. "Feel" is determined as the deformation (i.e. compression) of the ball under various load conditions applied across the ball's diameter. Generally, the lower the compression value, the softer the "feel." Consequently, two-piece golf balls have a higher initial velocity. In addition, typically two-piece golf balls have more potential energy, which is derived primarily from the core. The cores in two piece golf balls are typically larger than the centers in three-piece golf balls.

In contrast, three-piece golf balls with their smaller centers historically use softer cover materials. These softer cover materials result in a lower initial velocity when compared to two-piece golf balls. However, this difference in the initial velocity may be somewhat made up by the windings in the three-piece golf ball.

In addition to manipulating the core and cover of a golf ball, for many years golf balls have been made with surface indentations or depressions, called dimples, to improve their aerodynamic properties in flight. Specifically, ball manufacturers have looked to dimple configurations in an effort to design a ball with superior distance capabilities. Many efforts have been made to select the optimum number, size and shape of dimples as well as their disposition around the outer surface of a generally spherically shaped golf ball.

Ball manufacturers are bound by regulations of the United States Golf Association (USGA) which control many characteristics of the ball, including the size and weight of the ball, the initial velocity of the ball when tested under specified conditions, the overall distance the ball travels when hit under specified test conditions, and the ball's aerodynamic symmetry. Under USGA regulations, the diameter of the ball cannot be less than 1.680 inches, the weight of the ball cannot be greater than 1.620 ounces avoirdupois, the initial velocity of the ball cannot be greater than 250 feet per second when tested under specified conditions (with a maximum tolerance of +2%), the driver distance cannot exceed 280 yards when tested under specified conditions (with a test tolerance of +6%), and the ball must perform the same aerodynamically regardless of orientation.

While the USGA sets a limit for the distance a ball can travel under set test conditions, there is no upper limit on how far a player can hit a ball. For example, U.S. Pat. No. 4,142,727 to Shaw discloses the projection of a dodecahedron onto the ball as a basis for a dimple configuration in one of their preferred embodiments. The dodecahedron is formed by the projection of twelve (12) pentagons onto the balls surface. The preferred ball disclosed in this reference has a minimum of five (5) uninterrupted great circle paths present on the dimpled ball, and a major portion of the dimples present on the ball are within the boundaries of either a triangle, rhombus or pentagon.

In U.S. Pat. No. 5,192,078 to Woo discloses the use of a dodecahedron pattern in one of it preferred embodiments. The ball has six great circle paths which are free of dimples to further subdivide its surface pattern.

A problem with the prior art dimple configurations is that they fail to take into account other features of the ball, such as core size, core compression and cover hardness, which also influence how far a ball will travel.

U.S. Pat. No. 5,368,304 to Sullivan discloses a ball having a low spin rate, which in turn enables the ball to travel greater distances. According to the Sullivan patent, the low spin rate is the result of a soft core and hard cover. While the '304 patent discloses the use of a soft core and hard cover to lower the spin rate, it does not disclose a dimple configuration for the ball.

The invention addresses the shortcomings of the aforementioned art through the use of a specific combination of cover material, dimple pattern and other novel features not found in any known art combination.

OBJECT OF THE INVENTION

Accordingly, it is an object of the invention to provide a two-piece golf ball that has a soft feel in combination with superior distance capabilities.

It is another object of the invention to optimize the combination of core compression, core size, core composition, dimple configuration, cover composition, and cover hardness to provide a two-piece golf ball, which travels great distances, and at the same time complies with USGA regulations.

It is yet another object of the invention to provide a two-piece golf ball having a synthetic cover material that achieves excellent sound, feel, playability and flight performance qualities.

It is a further object of the invention to lower the cost of manufacturing a two-piece golf ball that has a soft feel in combination with superior distance capabilities.

It is still a further object of the invention is to provide a two-piece golf ball having superior distance, trajectory and flight stability.

Another object of the invention is to provide a two-piece golf ball having a surface divided into a plurality of polygonal configurations or shapes for the location of dimples for enhancing the aerodynamic properties of the golf ball.

SUMMARY OF THE INVENTION

The invention achieves the above-described objectives by providing a two piece golf ball having a solid rubber core, a synthetic ionomer resin cover, and a "dodecahed-ron" dimple pattern. The ball of the instant invention has a core compression in the range of 68 PGA to 82 PGA; a core diameter in the range of about 1.4 to 1.65 inches, preferably about 1.45 to about 1.6 inches, with a most preferred diameter of 1.504 inches to about 1.514 inches; a cover hardness in the range of about 60 to 70 Shore D and more preferably 62 Shore D to about 66 Shore D, and a dimple pattern based on the geometry of a dodecahedron.

This combination has been found to produce a ball with superior distance capabilities, which also satisfies USGA regulations. The use of these properties in the golf ball of the instant invention is based on the recognition that it is the combination of the core compression, core composition, core size, cover composition, cover hardness, dimple configuration, dimple size and dimple shape that will produce a ball that will travel the greatest distance without compromising shot-making feel.

The cover material must be constructed from a relatively stiff material, for example, synthetic thermoplastic materials. Most notably these synthetic thermoplastic materials are ionomeric resins. For superior properties and performance specific ionic polymer blends are required.

The present invention utilizes a greatly improved cover formulations for golf balls that corrects the deficiencies inherent in earlier blending attempts. It has been discovered that the blending of copolymers one or more of which may be an ionomer (such as ethylene-methacrylic acid, ethylene-acrylic copolymers or any other olefin-unsaturated carboxylic acid copolymer having similar properties wherein the acid level of the blend is 15–19% by total weight of the copolymer) having a moderately high modulus (45,000 to 60,000 PSI) with that of a moderately low modulus (10,000 to 14,000 PSI), wherein the acid groups of the ionic polymers are then partially neutralized by sodium, zinc, magnesium, or lithium either alone or in a any combination of the aforementioned ions results in a cover which has greater durability than prior art balls with a reduced hardness.

Therefore the playability of the ball is increased over prior art attempts at ionic polymer blends which attempted to blend very high modulus polymers with a very low modulus polymer producing a blend with a very high PDI, meaning a very broad range of individual polymer molecular weights within the blend which resulted in undesirable properties.

The cover material of the invention can be produced from the blends of various grades of resins formed from the co-polymerization of an olefin and an unsaturated carboxylic acid wherein at least one polymer is partially neutralized by a metal ion. A typical effective example of a copolymer of this invention is the copolymer of ethylene and unsaturated methacrylic acid. The invention is a blend of synthetic thermoplastic ionomeric resins produced by blending a moderately high modulus ionomeric (MHMI) polymer with a moderately low modulus polymer (MLMP). The average acid level of the final blend would be within the range of 13–19% by weight of acid. One or more of the copolymer blends of the instant invention are neutralized by a metal ion. The typical metal ions are lithium, magnesium, sodium or zinc. Examples of typical polymers that can be used in the cover composition which are commercially available and are sold by E. I. Dupont De Nemours & Company under the trademarks SURLYN and NUCREL.

As used herein, the term moderately high modulus ionomer (MHMI) shall be defined as a copolymer consisting of approximately 83–87% by weight of ethylene or other similarly performing olefin, 13–17% by weight of methacrylic acid or other similarly performing unsaturated carboxylic acid, where 10–90% of the acid groups are neutralized by sodium, zinc, magnesium or lithium ions. The MHMI will preferably have a melt index of 0.5 to 1.0 g/10 min., Shore D hardness of 60–70, and a flexural modulus between 45,000–55,000 PSI. The MHMI can have a melt index range of 0.5 to 7.0 g/10 min, Shore D hardness in a range of 55–75 and a flexural modulus from about 30,000 to 75,000 PSI.

As used herein, the term moderately low modulus polymer (MLMP) shall be defined as a copolymer consisting of approximately 79–83% by weight of ethylene or a similarly performing olefin, 13–17% by weight of methacrylic acid or similar performing unsaturated carboxylic acid. The MLMP will preferably have a melt index of 20-to 30-g/10 min., Shore D hardness of 57–67, and a flexural modulus between 10,000–14,000 PSI. An acceptable MLMP can have a melt index of 10 to 65 grams/10 min., Shore D hardness of 45 to 67, and a flexural modulus of about 5,000 to 25,000 PSI.

The methods for preparing the aforementioned polymers and ionomers are well known in the art and are described in U.S. Pat. No. 4,351,931 which is herein incorporated by reference. The method for preparation of high acid copolymers is a complicated process due to phase separation of the monomer-solvent phase. The method for producing a high acid copolymer is described in U.S. Pat. No. 4,351,931 that is also incorporated through reference herein. Once the ionic polymers have been produced the instant invention can be produced using any known conventional method of blending the copolymers.

A well know method in the art of blending polymers is through the use of a conventional extruder. The polymers can be melt blended in a temperature range of 175° to 220°

C. and processed conventionally. The material is not excessively shear sensitive so any amount which results in sufficient mixing is acceptable. Once the cover material is sufficiently blended the golf ball can be produced by any known method. A conventional method of producing golf ball covers is described in U.S. Pat. No. 5,000,459 that is herein incorporated by reference.

Additionally compatible additives may be added to the cover blend of the instant invention. Examples of common additives are dyes and colorants such as titanium dioxide, zinc oxide, zinc sulfate and fluorescent pigments. As shown by U.S. Pat. No. 4,884,814 the loading of pigment or dye into a polymeric cover is dependant upon the base polymer utilized and the desired colorant to be added to the polymer. The final amount of colorant is dependent on the exact polymer blend and should be adjusted accordingly. The ideal loading level for colorant usually falls in the range of about 5% of the total weight of the cover.

Suitable for the present invention the cover blend composition will include 55–80% by weight of at least one MHMI polymers consisting of approximately 83–87% by weight of ethylene or a similarly performing olefin, 13–17% by weight of methacrylic acid or similar performing unsaturated carboxylic acid, where 10–90% of the acid groups are neutralized by sodium, zinc, magnesium or lithium ions and will have a melt index of preferably 0.5 to 1.0 g/10 min. but an acceptable range is 0.5 to 7.0 grams/10 min., preferably a Shore D hardness of 60–70 but an acceptable range is 55–75 Shore D, and preferably a flexural modulus between 45,000–55,000 PSI but an acceptable range is 30,000 to 75,000 PSI, and 20–45% by weight of at least one MLMP polymer consisting of approximately 79–83% by weight of ethylene or a similarly performing olefin, 17–21% by weight of methacrylic acid or similar performing unsaturated carboxylic acid and a preferable melt index of 20 to 30 g/10 min. but an acceptable range is 10 to 65 g/10 min., preferably having a Shore D hardness of 57–67 but an acceptable range is 45 to 67 Shore D, and a preferred flexural modulus between 10,000–14,000 PSI but an acceptable range is 5,000 to 25,000 PSI with the resulting final acid level between 13–21% by weight of acid. There are many commercial grades available which would satisfy these requirements of the instant invention.

In one preferred embodiment a blend of polymers with at least one polymer of a moderate modulus (10,000 to 14,000 PSI) and a high acid level having a Shore D of preferably approximately 63 but may range from 60 to 67, combined with at least one additional ionomeric copolymer having a high modulus (45,000 to 55,000 PSI), and medium acid level with a Shore D of approximately 65 but may range from 62 to 69 being partially neutralized by either sodium or zinc produces a cover with superior characteristics. This blend results in a golf ball cover with improved playability characteristics.

In another preferred embodiment the cover is a polymer blend of three copolymers with at least one of the polymers an ionic copolymers. The first component of the polymer blend consists of an ethylene/methacrylic acid copolymer with an acid level of 15% to 19% by weight wherein it is 20–45% by weight of the total blend, preferably 20 to 35%, and most preferably 25% by weight. The second component of the polymer blend consists of ethylene/methacrylic acid copolymer with an acid level of 15% neutralized by zinc ions wherein it is up to 50% by weight of the total blend, preferably 20 to 40%, and most preferably 30% by weight. The third component of the polymer blend consists of ethylene/methacrylic acid copolymer with an acid level of 15% neutralized by sodium ions wherein it is 10–90% by weight of the total blend, preferably 25 to 60%, and most preferably 45% by weight.

For the purposes of illustration the DUPONT ionomer resin grade designations for an ionomer define a low acid level is approximately 12% by weight, a medium acid level is approximately 15% by weight and a high acid level is approximately 19% by weight.

In a preferred embodiment composed of commercial available polymers from DUPONT for illustrative purposes only is the following; the polymer blend is 45% by weight of SURLYN 8920 or 8945, 30% by weight of SURLYN 9910 and 25% by weight of NUCREL 2906 or 925. As discussed previously, the cover material is comprised of ionomer resins and polymers available from E. I. du Pont de Nemours & Co. under the name SURLYN and NUCREL. The hardness of the cover produced by this blend formulation is about 64±3 Shore D.

In the aforementioned illustrative cover formulation SURLYN 8920 can comprise from 10 to 90% by weight, SURLYN 9910 can comprise from 0 to 50% by weight and NUCREL can comprise 20 to 45% by weight of the total formulation. The invention is not limited to these commercial grades but other similar grades may be substituted.

As mentioned previously, in addition to manipulating the core and cover parameters in a golf ball, superior aerodynamic properties are also attributed to the dimple configuration on a golf ball. In the invention, the dimples are arranged on the surface of the golf ball based on the geometry of a dodecahedron. This configuration is achieved by dividing the outer spherical surface of a golf ball into a plurality of polygonal configurations using pentagons subdivided into triangular rows for locating a plurality of dimples on the outer surface of the golf ball. This first plurality of polygonal configurations is generally referred to herein as a "modified dodecahedron".

The first polygonal configurations consist of three pentagons symmetrically disposed around the first pole and three additional pentagons disposed around a second pole. Three pentagons in each polar region share a pole as a common vertex for a total of six pentagons associated with the polar regions. There are six remaining pentagons which are associated with the equatorial region (mold parting line) of the ball surface. The outer surface has a plurality of dimples of different sizes. For this embodiment, the dimples are of first, second and third sizes and are generally located to have a pattern associated with the pentagons and subsequent triangles and rows. The dodecahedron pattern is further defined by the presence of ten great circles paths upon the ball, one of which is the equator or parting line of the ball. Dimples are preferably circular in shape, but can have a non-circular shape within the scope of this invention.

The combination of the aforementioned core, cover and dimple specifications produces a golf ball that possesses noticeable improvements in playability (i.e. spin properties) without sacrificing the ball's durability (i.e. impact resistance etc.) which in turn relates directly to the distance a ball will travel when struck. In addition, the instant invention provides a golf ball composition that exhibits the desired properties of the three-piece wound ball (e.g. long distance in combination with a soft feel), but with the lower manufacture cost associated with the two-piece ball. These and other objects of the instant invention will be apparent from a reading of the following detailed description of the instant invention.

DETAILED DESCRIPTION OF THE PREFERRED EMBODIMENT

Figure 1:
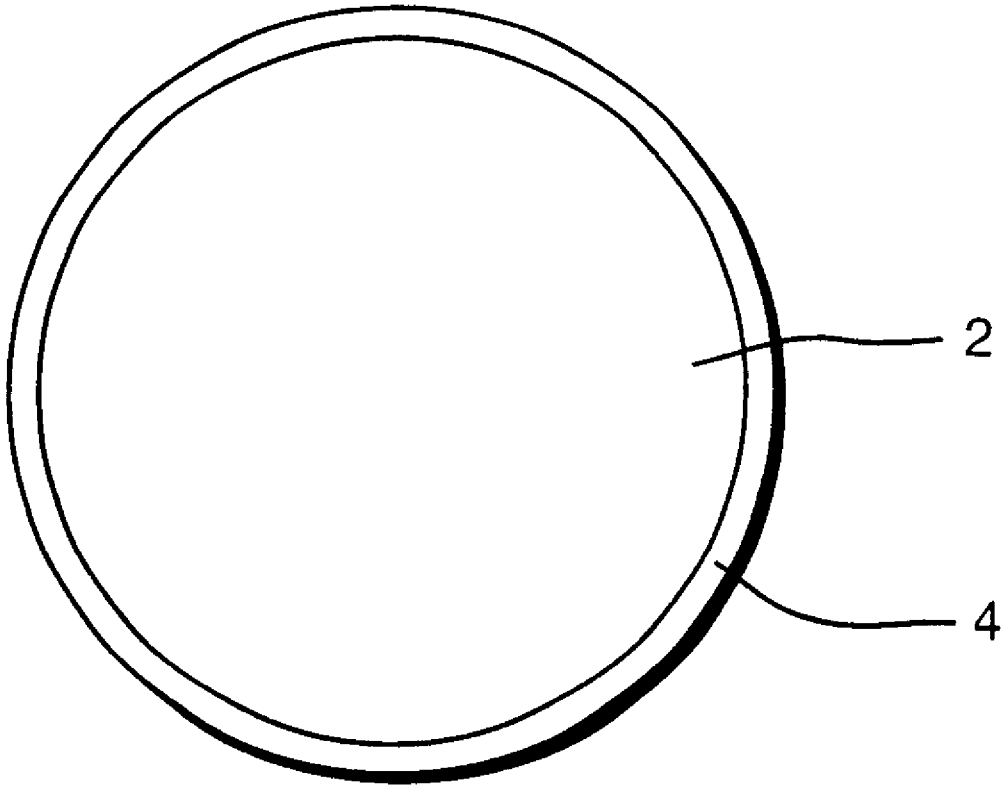
FIG. 1 is a sectional view of a golf ball made in accordance with one embodiment of the invention.

FIG. 1 shows a section view of a two-piece golf ball made in accordance with the preferred embodiment of the invention. A two-piece golf ball has a solid rubber core 2 and a cover 4. The solid rubber core 2 is manufactured by using conventional compression molding processes. The components are mixed together and extruded to form performs, which are then placed in cavities in the mold and are compression molded under pressure and cured/vulcanized to form cores. The same mix may also be injection molded. Curing is carried out in the mold at temperatures of 280–380 degrees F. for five to twenty minutes depending on the compound. Once fully cured, the cores are removed from the mold cavities and prepared for application of a cover.

In the preferred embodiment, the golf ball core 2 is made of a solid rubber composition comprising a polybutadiene rubber center of a composition typical to the industry. Specifically, the rubber may be 90–100 PHR polybutadiene rubber, 0–10 PHR polyisoprene rubber, 20–40 PHR zinc diacrylate, 3–10 PHR zinc oxide, 8–40 PHR fillers, process aids and antioxidants, and 0.5–5 PHR peroxide initiator. In the preferred embodiment, the diameter of the solid rubber core 2 is about 1.509±0.005", but an acceptable range is about 1.4 to 1.63 inches. The preferred core 2 weighs about 34.50±0.50 grams, but an acceptable range is 31 to 43 grams, and has a compression of about 75±7 PGA.

As is well known in the art, the type and amount of crosslinking agents used to make the core will have the greatest influence on the core compression achieved. To prepare the core 2 according to the preferred embodiment, it has been found that a core composed primarily of high-cis polybutadiene in combination with cross-linking agents, activators, initiators and fillers (active and inactive), can be used to achieve a golf ball core having the desired compression characteristics. As used herein, high-cis means a cis isomer content of greater than 93%. It is to be understood that the core formula set forth herein is but one formula that can be used to make a core having the desired core compression.

Once formed, the solid rubber core 2 is then subjected to a conventional molding process whereby the polymer cover 4 is injection or compression molded around the core 2 in a manner well known to those skilled in the art. To make the cover, the blended components of the cover are injection or compression molded into cavities, which contain cores suspended in the center of the cavities. The inner surfaces of the cavities are constructed with dimple-shaped projections, which form the dimples in the cover. The process used to make the cover is the standard process used and well known in the art wherein one or more components are added together to form a blend that is then injected into the mold. Any method of producing the cover known now or hereafter is acceptable for making the cover. After molding, the golf balls produced may undergo further processing steps such as pressure blasting, vibratory finishing, stamping of the logo, application of a primer, and finally, application of a top coat.

In the preferred embodiment, the cover has a thickness of about 0.085" leading to provide a total diameter of core and cover of 1.680" to 1.686", the commercial ball diameter standard specified by the United States Golf Association.

As discussed previously, the cover material is preferably comprised of resins available from E. I. du Pont de Nemours & Co. under the name SURLYN and NUCREL. In the preferred embodiment, the ionomers are 45% by weight of SURLYN 8920 or 8945 and 30% by weight of SURLYN 9910 and 25% by weight of NUCREL 2906 or 925. The hardness of the cover is preferably about 62±3 Shore D but may range from 55–67 Shore D.

Turning now to the dimple technology employed in the instant invention, as stated previously, the preferred geometry is a dodecahedron. Accordingly, the scope of this invention provides a golf ball mold whose molding surface contains a uniform pattern to give the golf ball a dimple configuration superior to those of the art. The invention is preferably described in terms of the golf ball that results from the mold, but could be described within the scope of this invention in terms of the mold structure that produces a golf ball.

Figure 2:
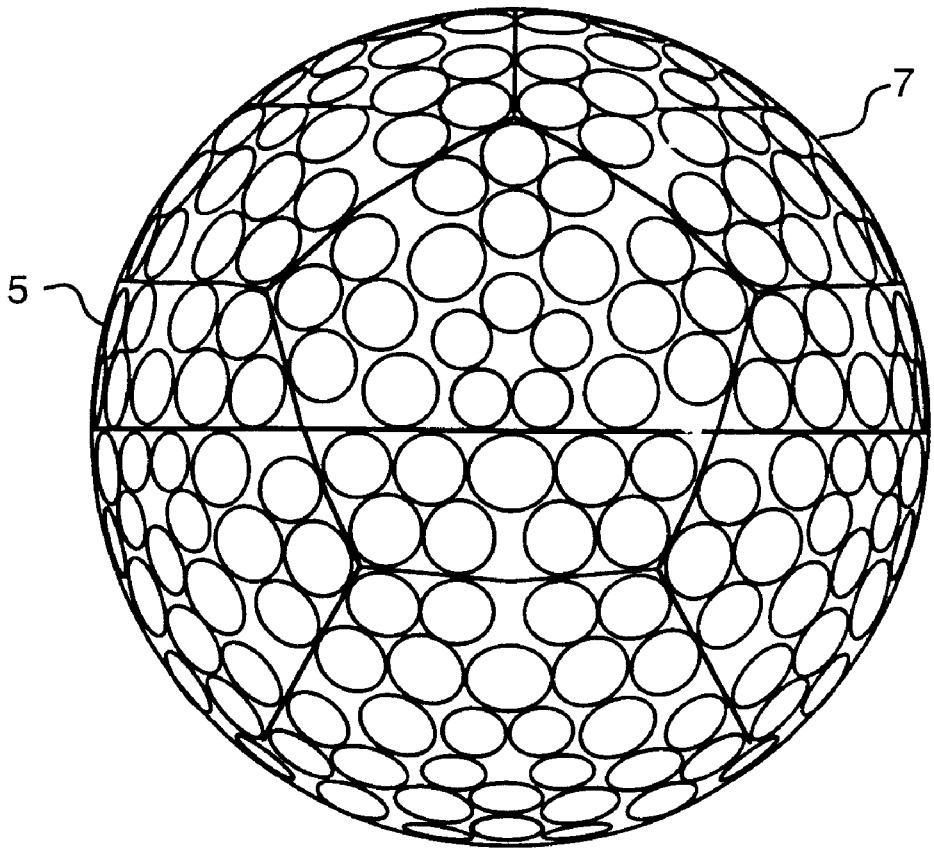
FIG. 2 is an elevation view of the outer surface of a golf ban being divided into a plurality of polygonal configurations according to the invention.

To assist in locating the dimples on the golf ball, the golf ball of this invention has its outer spherical surface partitioned by the projection of a plurality of polygonal configurations onto the outer surface. That is, the formation or division that results from a particular arrangement of different polygons on the outer surface of a golf ball is referred to herein as a "plurality of polygonal configurations." A view of one side of a golf ball 5 showing a preferred division of the golf ball's outer surface 7 is illustrated in FIG. 2.

Figure 3:
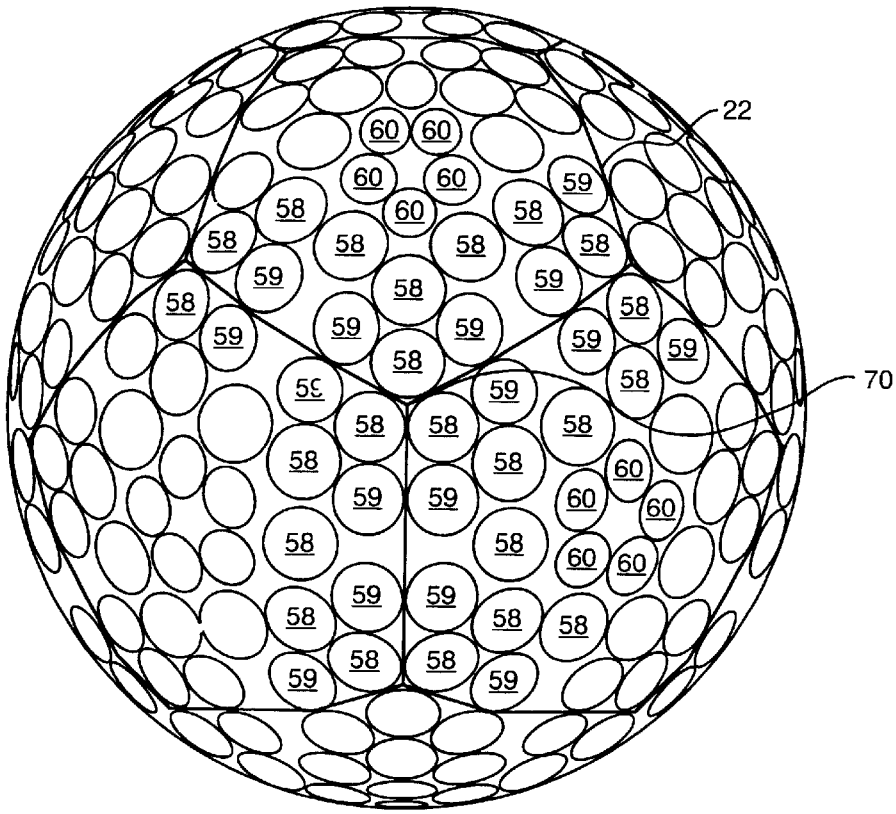
FIG. 3 is a polar view of the pentagons projected onto the surface of the ball FIG. 4. is the ball with great circles projected upon the surface.

In FIG. 3 of the preferred embodiment, a polygonal configuration known as a dodecahedron is projected onto the surface of a sphere. A dodecahedron is a type of polyhedron which contains twelve (12) polyhedra. The term "dodecahedron" means a twelve (12) sided polyhedron. The dodecahedron of the preferred embodiment is comprised of, twelve (12) pentagons 22, which is then subdivided into sixty (60) triangles 14. It has a uniform pattern of pentagons with each pentagon subdivided into triangles and then rows.

Figure 4:
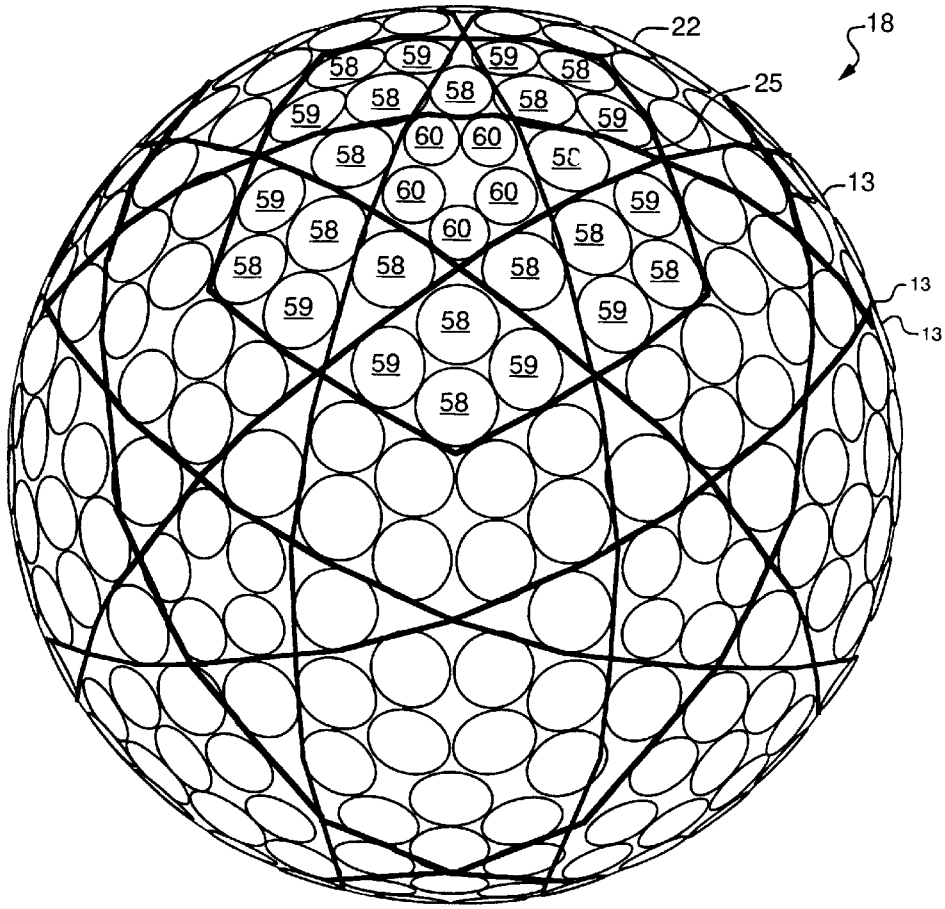

As shown in the planar view in FIG. 4, the outer surface of the ball is further defined by a pair of poles and an uninterrupted equatorial great circle path around the surface. A great circle path is defined by the intersection between the spherical surface and a plane which passes through the center of the sphere. There are ten uninterrupted great circle paths 13 on the surface of the golf ball in the preferred embodiment one of which corresponds to the mold parting line. The uninterrupted great circle path is uninterrupted as a result of being free of dimples. The mold parting line is located from the poles in substantially the same manner as the equator of the earth is located from the north and south poles.

There are ten uninterrupted great circle paths 13 on the surface of the golf ball in the preferred embodiment which further defines the surface of the golf ball. Every uninterrupted great circle path 13 defines one side of three smaller pentagons 25 made up of five dimples 60 inside of pentagon 22 that makes up the dodecahedron, as displayed in FIG. 5. In addition, at every edge 14 or side midpoint A of the pentagon 22, two uninterrupted great circle paths 13 intersect.

Figure 6:
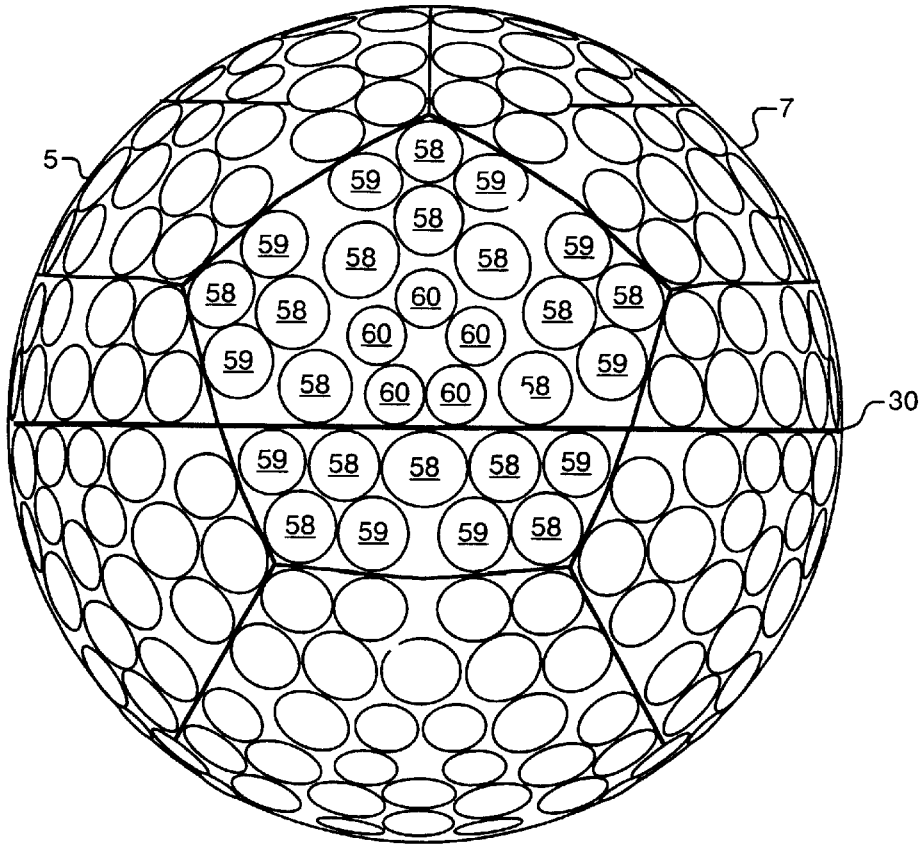
FIG. 6 is an equatorial view of pentagons being projected onto the surface of the ball.
Figure 7:
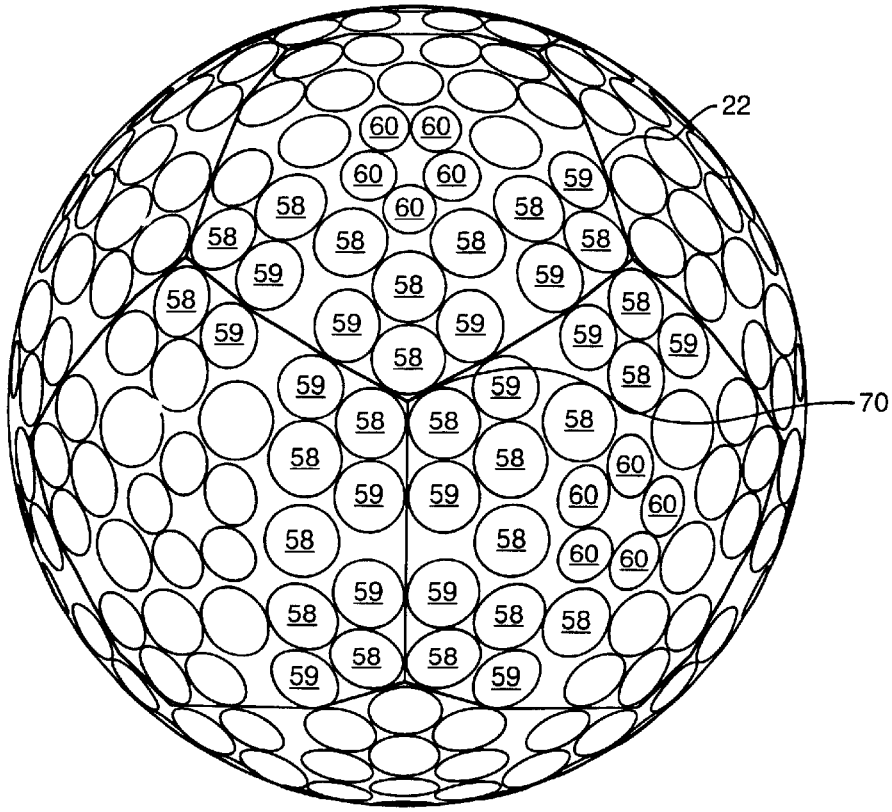
FIG. 7 is a polar view of pentagons projected upon the balls surface.

Referring to FIGS. 6 & 7, the poles 70 are located at the vertices of three pentagons 22 on the top and three pentagons 22 on the bottom side of the ball, as illustrated in this view of one such side. The mold parting line 30 is at the outer edge of the circle in this planar view of FIG. 7 of the golf ball.

Figure 8:
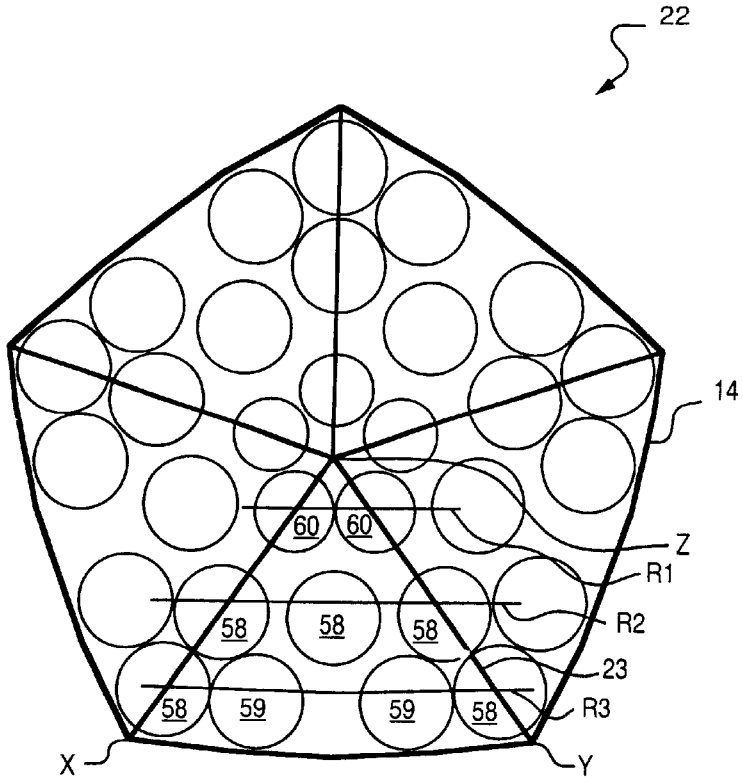
FIG. 8 is a view of a pentagon further subdivided into triangles and rows.

Referring to FIG. 8, each of the twelve pentagons 22 established by the projection of the dodecahedron onto the outer ball surface 5, is further subdivided into five similar triangles 23. Within triangle 23, there are five dimples 58, two dimples 59, and two dimples 60. Each row can be described as having (R+1) dimples, where R is the row designation. Row three contains two dimples 58, and two dimples 59. Row two contains three dimples 58. Row one contains two dimples 60. The seam line 12 intersects six of the pentagons 22.

Dimple size is measured by a diameter and depth generally according to the teachings of U.S. Pat. No. 4,936,587 (the '587 patent), which is included herein by reference thereto.

Figure 9:
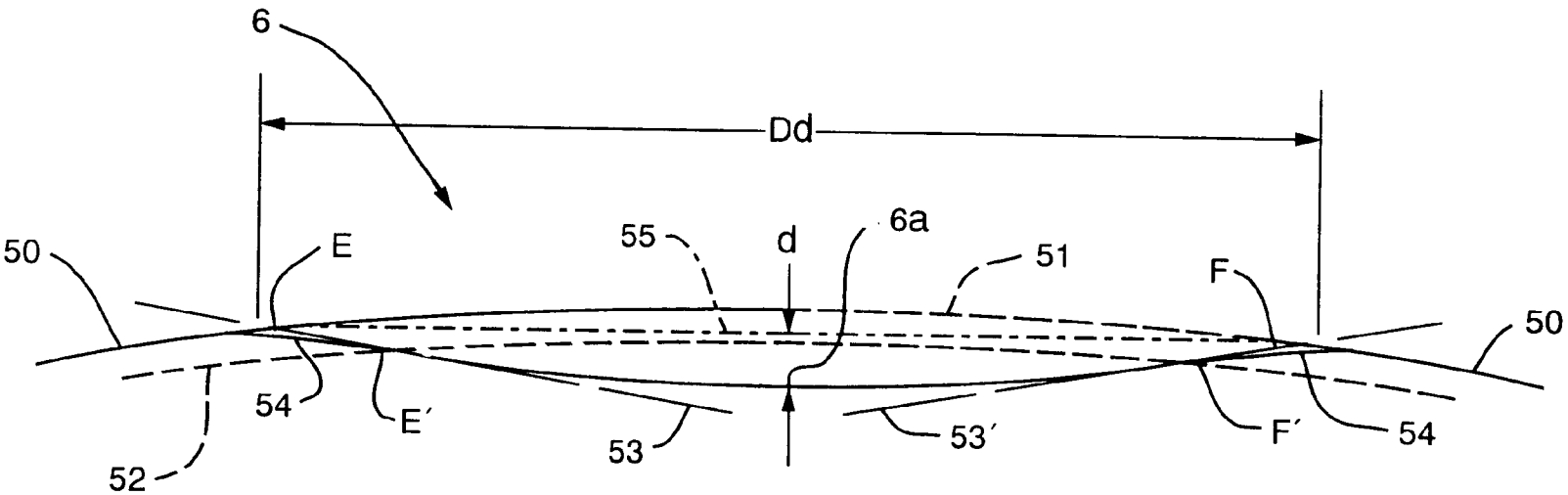
FIG. 9 is a cross sectional view cut through one of the dimples on the outer surface of the ball.

In FIG. 9, illustrates an exception to the teaching of the '587 patent is the measurement of the depth, which is discussed below. A cross-sectional view through a typical dimple 6 is illustrated in FIG. 7. The diameter Dd used herein is defined as the distance from edge E to edge F of the dimple. Edges are constructed in this cross-sectional view of the dimple by having a periphery 50 and a continuation thereof 51 of the dimple 6. The periphery and its continuation are substantially a smooth surface of a sphere. An arc 52 is inset about 0.003 inches below curve 50-51-50 and intersects the dimple at point E' and F'. Tangents 53 and 53' are tangent to the dimple 6 at points E' and F' respectively and intersect periphery continuation 51 at edges E and F respectively. The exception to the teaching of '587 noted above is that the depth d is defined herein to be the distance from the chord 55 between edges E an F of the dimple 6 to the deepest part of the dimple cross sectional surface 6 (a), rather than a continuation of the periphery 51 of an outer surface 50 of the golf ball.

Figure 5:
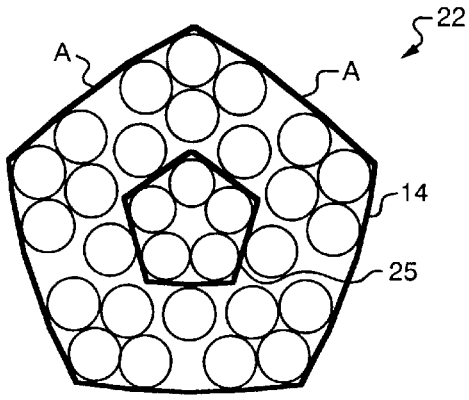
FIG. 5 is a pentagon that is further subdivided by great circles.

In the preferred embodiment, dimples 58, 59, and 60 are dual radius in nature. An acceptable dimple diameter range for any dimple on the ball is from about 0.075 to 0.25 inches, and acceptable dimple depth ranges from about 0.0025 to about 0.0125 inches. As seen in FIG. 5, dimples 58 have a diameter Dd of 0.1535"and a corresponding depth d of 0.0062" (as measured from the cord 55 to the bottom of dimple 54). Dimples 59 have a diameter Dd of 0.1457" and a corresponding depth d of 0.0062" (as measured from the cord 55 to the bottom of dimple 54). Dimples 60 have a diameter Dd of 0.1248" and a corresponding depth d of 0.0062" (as measured from the cord 55 to the bottom of dimple 54).

In the preferred embodiment the golf ball cover is defined by the strategic placement of 360 dimples over the surface of the ball. The dimples of the ball are defined by their numbers and their diameters.

As shown in FIG. 10, a single radius dimple is defined as having one radius that defines the profile of the dimple. A dual radius dimple has two radii that define the dimple profile. For dimples 58, 59, and 60, R1 is 0.7874" and R2 is 0.1181". A major radius (Radius 1) describes the bottom of the dimple (i.e. it governs the shape of the dimple toward the bottom of the dimple). A minor radius (Radius 2) governs the shape of the dimple about its circumference. As noted below, in some embodiments, these radii may be equal. RI defines the "bottom" portion of the dimple, R2 defines the "side" portion of the dimple.

The preferred embodiment of the present invention is further defined by the presence of bald patches upon the ball surface. In the preferred embodiment there are 30 bald patches evenly disposed over the surface of the golf ball. The bald patches are located at the midpoints of the sides of all the pentagons projected onto the surface. At that midpoint, any two uninterrupted great circle paths intersect.

The bald patches can be further defined by their geometric shape. The bald patches are rectangular in shape and are determined by the mean dimple diameter of the golf ball. The rectangle has a width of at least half the mean dimple diameter and an area of more than eight times the mean dimple area. Preferably the width of the rectangle is at least three quarters of the mean dimple diameter, while the rectangle is at least four times the mean dimple diameter Dimples are placed on the outer surface of the golf ball based on segments of the plurality of polygonal configurations described above. In the preferred embodiment, thirty (30) dimples are associated with each pentagon. The term "associated" as used herein in relation to the dimples and the polyhedra means that the polyhedra are used as a guide for placing the dimples.

In the preferred embodiment, there are a total of 360 dimples. Advantageously, this decrease in the number of dimples when compared to prior art golf balls results in a geometrical configuration that contributes to the aerodynamic stability of the instant golf ball. Aerodynamic stability is reflected in greater control over the movement of the instant golf ball.

Advantageously, the use of dimples that are dual radius in cross section improves the performance of the instant golf ball with respect to both distance and control of the movement of the golf ball. The presence of dual radius dimples allows for a soft trajectory in golf ball's flight. In turn, this soft trajectory leads to a soft entry of the golf ball onto the golf course green, which in turn results in greater control over the movement of the instant golf ball.

The following examples are provided to illustrate and further explain the beneficial effects of the ball described above. These examples are set forth for the purposes of illustrating the advantages obtained with the combination of the core compression, core size, cover composition, cover hardness, cover thickness, dimple configuration, and dimple number that will produce a ball that will travel the greatest distance without compromising shot-making feel.

It will be appreciated that the instant specification and claims are set forth by way of illustration and do not depart from the spirit and scope of the instant invention. It is to be understood that the instant invention is by no means limited to the particular embodiments herein disclosed, but also comprises any modifications or equivalents within the scope of the claims.

Having thus described my invention, what I claim as new and desire to secure by United States Letters Patent is:

1. A golf ball comprising:

a core;

a cover comprising an ionomeric polymer of at least one moderately high modulus ionomer and at least one moderately low modulus copolymer having a flexural modulus of 10,000 to 14,000 PSI wherein said blend is disposed over said core; and, a plurality of dimples arranged in a modified dodecahedron pattern wherein said plurality of dimples are arranged to form at least 30 bald patches free of dimples.

2. The ball of claim 1 wherein the moderately high modulus ionomer is a copolymer consisting of approximately 80–90% by weight of an olefin, 10–20% by weight of unsaturated carboxylic acid wherein 10–90% of an acid groups formed are neutralized by an ion donor and wherein said dimples are arranged in a pattern of twelve pentagons.

3. The ball of claim 2 wherein the olefin is ethylene, wherein the unsaturated carboxylic acid is methacrylic acid and the acid groups are neutralized by the ion donor selected from the group consisting of sodium, zinc, magnesium and lithium ions or mixtures thereof and said pentagons are divided into a plurality of triangles.

4. The ball of claim 2 wherein the moderately low modulus copolymer consisting of approximately 79–90% by weight of an olefin, 10–21% by weight of unsaturated carboxylic acid and where said pentagons are subdivided into a plurality of triangles, wherein said triangles are subdivided into said rows.

5. The ball of claim 4 wherein said moderately high modulus ionomer comprises ethylene, wherein said unsaturated carboxylic acid is methacrylic acid and wherein said ion donor is selected from the group consisting of sodium, zinc, magnesium and lithium ions or mixtures thereof and has a melt index of 0.5 to 1.0 grams/10 minutes, a flexural modulus of about 30,000 to 75,000 PSI, and a Shore D hardness of about 55–75 wherein said dimples are arranged to produce ten great circles on said cover which are free of said dimples.

6. The ball of claim 5 wherein said moderately low modulus polymer comprises ethylene, wherein said unsaturated carboxylic acid is methacrylic acid and has a melt index of 10 to 65 grams/10 minutes, and a Shore D hardness of about 45–67 wherein said rows further comprises:

a first row wherein said row is adjacent to an apex of said triangle;

a second row adjacent to said first row;

a third row adjacent to said second row wherein said second row lies between said first row and said third row.

7. The golf ball of claim 6 wherein said cover has a Shore D of about 61 to 67 and further comprising:

a first dimple arranged to coincide with said first row;

a second dimple arranged to coincide with said second row and said third row; and, a third dimple arranged to coincide with said third row.

8. The golf ball of claim 7 wherein said third row comprises four dimples wherein two said third dimples are sandwiched between two said second dimples.

9. The golf ball of claim 7 wherein said first dimple, said second dimple and said third dimple have different diameters and different depths.

10. The ball of claim 1 wherein the moderately low modulus copolymer consisting of approximately 79–90% by weight of an olefin, 10–21% by weight of unsaturated carboxylic acid and said dimples are arranged to coincide with a pattern of triangles within twelve pentagons.

11. The golf ball of claim 1 wherein said dimples have dual radii.

12. A golf ball comprising:

a core;

a cover comprising an ionomeric polymer blend which comprises:

at least one moderately high modulus ionomer (MHMI) wherein said MHMT is a copolymer comprising 80–90% by weight of ethylene, 10–20% by weight of methacrylic acid, wherein said MHMI is neutralized by an ion selected from the group consisting of sodium, zinc, magnesium and lithium or mixtures thereof; and, at least one moderately low modulus polymer (MLMP) wherein said MLMP is a copolymer comprising 80–90% by weight of ethylene, 10–20% by weight of methacrylic acid, said MLMP has a flexural modulus of 10,000 to 14,000 PSI, wherein said MLMP is neutralized by an ion selected from the group consisting of sodium, zinc, magnesium and lithium or mixtures thereof;

wherein said cover is disposed over said core; and, a plurality of dimples arranged to coincide with a modified dodecahedron pattern.

13. The golf ball of claim 12 wherein said MHMI has a melt index of 0.5 to 7.0 grams/10 minutes, a Shore D hardness of 55–75, and a flexural modulus of of about 30,000 to 75,000 PSI wherein said dimples are further arranged to coincide with a plurality of triangles.

14. The golf ball of claim 13 wherein the MLMP has a melt index of 10 to 65 grams/10 minutes, a Shore D hardness of 45–67 wherein said triangles are subdivided into a plurality of rows.

15. The golf ball of claim 12 wherein the golf ball cover comprises a blend of at least three copolymers wherein at least one copolymer is an ionic copolymer comprising a first polymer component comprising 20% to 45% of said blend by weight wherein said first polymer component is an ethylene/methacrylic acid copolymer with an acid level of 15% by weight;

a second polymer component comprising 5% to 50% of said blend by weight wherein said second polymer component is an ethylene/methacrylic acid copolymer with an acid level of 15% by weight;

a third polymer component comprising 25% to 60% by weight of said blend wherein said third polymer component is an ethylene/methacrylic acid copolymer with an acid level of 15%; and, a plurality of triangles wherein said dodecahedron is subdivided into a plurality of said triangles;

a plurality of rows wherein said triangles are subdivided into rows;

a plurality of dimples associated with said rows.

16. A golf ball comprising:

a core;

a cover wherein said cover is a polymer blend comprising:

a first blend polymer having a melt index of 0.5 to 7.0 g/10 minutes, Shore D hardness of 55–75, and a flexural modulus of about 30,000 to 75,000 PSI;

at least one additional blend polymer wherein said additional blend polymer is completely miscible with said first blend polymer, has a melt index of 10 to 65 g/10 minutes, Shore D hardness of 45 to 67, a flexural modulus of 10,000 to 14,000 PSI forming a cover which is disposed upon said core; and, a plurality of dimples arranged to coincide with a modified dodecahedron pattern.

17. The golf ball of claim 16 wherein said first blend polymer is an ethylene/methacrylic acid copolymer having a 15% by weight acid level partially neutralized by sodium ions comprising 10% to 90% by weight of said blend;

wherein at least one said additional blend polymer is an ethylene/methacrylic acid copolymer having a 15% by weight acid level partially neutralized by zinc ions comprising 0 to 50% by weight of said blend;

further comprising a third ethylene/methacrylic acid copolymer having a 15% by weight acid comprising 20 to 45% by weight of said blend; and, a plurality of pentagons wherein said dodecahedron pattern is subdivided by said pentagons, wherein said pentagons are further subdivided by a plurality of triangles.

18. The golf ball according to claim 17 wherein said first blend polymer is 25% to 65% by weight, said additional polymer is 20% to 40% by weight and said third copolymer is 25% to 35% by weight and wherein said dimples are arranged to coincide with a plurality of rows formed in said triangles.

19. The golf ball according to claim 18 wherein said first blend polymer is about 45% by weight, said additional polymer is about 30% by weight and said third copolymer is about 25% by weight further comprising:

a first row wherein said row is adjacent to an apex of said triangle;

a second row adjacent to said first row;

a third row adjacent to said second row wherein said second row lies between said first road and said third row.

20. The golf ball of claim 19 wherein said cover has a Shore D of about 61 to 67 and further comprising:

a first dimple arranged to coincide with said first row;

a second dimple arranged to coincide with said second row and said third row; and, a third dimple arranged to coincide with said third row.

21. The golf ball of claim 20 wherein the cover has a thickness of about 0.06 to 0.09 inches and wherein said third row comprises four dimples wherein two said third dimples are sandwiched between two said second dimples.

22. The golf ball of claim 21 wherein said golf ball contains 360 dimples.

23. The golf ball of claim 16 wherein said dimples are arranged so that ten great circle paths are formed on said cover free of said dimples.

* * * * *